US008225556B2

(12) United States Patent
Brown

(10) Patent No.: US 8,225,556 B2
(45) Date of Patent: Jul. 24, 2012

(54) SELF CLEANING GUTTER SYSTEM AND GUTTER BRACKET

(76) Inventor: Russell Perry Brown, Lexington, KY (US)

( * ) Notice: Subject to any disclaimer, the term of this patent is extended or adjusted under 35 U.S.C. 154(b) by 0 days.

(21) Appl. No.: 10/969,548

(22) Filed: Oct. 19, 2004

(65) Prior Publication Data

US 2006/0080898 A1 Apr. 20, 2006

(51) Int. Cl.
*E04D 13/072* (2006.01)
*E04D 13/064* (2006.01)

(52) U.S. Cl. ..... 52/12; 52/11; 248/48.1; 248/48.2

(58) Field of Classification Search ..... 52/11, 12, 52/16; 248/48.1, 48.2
See application file for complete search history.

(56) References Cited

U.S. PATENT DOCUMENTS 4,210,301 A * 7/1980 Weiss ..... 248/48.2
4,294,422 A * 10/1981 Odekirk ..... 248/48.2
4,650,702 A * 3/1987 Whitmyer ..... 428/31
5,040,750 A * 8/1991 Brant ..... 248/48.2
5,155,958 A * 10/1992 Huff ..... 52/235
5,617,678 A * 4/1997 Morandin et al. ..... 52/11
6,055,787 A * 5/2000 Gerhaher et al. ..... 52/546
6,289,644 B1 * 9/2001 Gerhaher ..... 52/235
6,658,796 B1 * 12/2003 Higgins ..... 52/11
6,681,527 B2 * 1/2004 Baker ..... 52/12
6,701,674 B1 * 3/2004 Albracht ..... 52/12
6,732,477 B1 * 5/2004 Richard ..... 52/12
6,745,517 B2 * 6/2004 Vahldieck ..... 52/12
6,993,870 B2 * 2/2006 McDonald et al. ..... 52/11
7,117,642 B2 * 10/2006 Brown ..... 52/11
7,117,643 B2 * 10/2006 Brown ..... 52/12
2004/0025445 A1 * 2/2004 Walters ..... 52/11
2005/0082436 A1 * 4/2005 Snell ..... 248/48.2

* cited by examiner

*Primary Examiner* — Phi D. A
(74) *Attorney, Agent, or Firm* — Francis Law Office PLLC; James M. Francis

(57) ABSTRACT

This invention relates to capped gutter systems and more specifically the bracket which supports the gutter cap and onto which the gutter is mounted and affixed to the roofline. No gutter cap or screen can completely eliminate the introduction of debris into the gutter channel. The present invention meets the long felt need for a gutter system that inhibits the introduction of debris into the gutter channel and helps flush out debris that manages to accumulate in the gutter. The present invention utilizes a gutter bracket which pushes the front of the gutter down, thus forcing water and debris to collect along the front bottom edge. The act of creating a low point along the forward bottom edge of the gutter concentrates the debris in this low point and accelerates the flow of water due to the decrease in volume, thus increasing the amount of energy available within the channeled water for debris removal. The present invention also facilitates the insertion of a gutter cap behind the roof drip edge and provides for temporary support during hardware installation.

7 Claims, 3 Drawing Sheets

SELF CLEANING GUTTER SYSTEM AND GUTTER BRACKET

CROSS REFERENCE TO RELATED APPLICATIONS

This application claims priority from U.S. Provisional Application No. 60/511,427 filed on Oct. 16, 2003. This application relates to a self cleaning gutter system and gutter bracket. The entire disclosure contained in U.S. Provisional Application No. 60/511,427 including the attachments thereto, are incorporated herein by reference.

BACKGROUND OF THE INVENTION

1. Field of the Invention

This invention relates to capped gutter systems and more specifically the bracket which supports the gutter cap and onto which the gutter is mounted and affixed to the roofline.

2. Problems in the Art

Traditional gutter systems are plagued by clogging caused by accumulated debris, the majority of which comes from trees. Leaves and twigs collect within conventional gutter systems and can plug the downspouts or prevent the flow of water within the gutter to the downspout. This clogging prevents effective rainwater collection and channeling to drainage points along the roofline. Clogging can also cause slow draining of the gutters and may result in spillover from the gutter along the roofline at low points. The gutters can pull away from the roofline due to the weight of the water accumulating within the gutter channels. The most serious problem occurs when the accumulated water spills over the rear of the gutters and flows under the roof along the frame to eventually collect on top of the ceiling or elsewhere within the building interior to cause damage and facilitate the growth of mold.

Numerous methods and devices may be found in the patent literature and are otherwise known to those skilled in the art of rainwater management. A very early patent, U.S. Pat. No. 546,042, Eaves Trough or Gutter Shield by Van Horn (Sep. 10, 1895), describes the use of a cover to deflect debris from the gutter while permitting water to enter. Numerous improvements to this patent can be found throughout the patent literature and are known to those skilled in the art, but the base concept remains the same.

Another very early patent, U.S. Pat. No. 603,611, Eaves Trough by Nye (May 3, 1898), describes "an eves hanging trough having its inner wall carried upward above said trough, thence outward over said trough, and backward to the line of attachment to the roof, all in gentle curves . . . ". The Nye device operates by directing water which runs off the roof of a building to which it is attached onto the portion of the inner wall thereof which is carried outward over the trough thereof and then into said trough, while simultaneously sweeping leaves and other debris off the system, and thereby preventing them from entering said trough. The Nye device is best visualized as comprising a backward "S" shape in side cross section, the upper edge of which is mounted to the eves of a building to which said Nye system is affixed. A more recent patent, U.S. Pat. No. 4,493,588, Non-clogging Eaves Trough by Duffy (Jan. 15, 1985), describes a system essentially similar to the Nye device, in which "the curved portion overhangs the trough and a generally vertical screen extends between the trough and the curved portion . . . ". A screen is present to further prevent leaves, twigs and other debris from entering the trough thereof. The upper edge of the Duffy system mounts under shingles on a roof of a building to which said system is affixed.

Yet another gutter system which provides benefits similar to those provided by the Nye invention is described in U.S. Pat. No. 4,757,649, Leaf Rejecting Rain Gutter by Vahldieck (Jul. 19, 1988). The Vahldieck invention comprises "a continuous double-curved convolute curve, generated on a first and second radius, which extends from the back wall, down short of the inside wall of the trough, and inward over the trough". The Vahldieck system is best visualized as being essentially of a squared "C" shape in side cross section, with the edge of the lower extent of said squared "C" shape being bent upward to form said trough, and with the with the upper extent of said squared "C" shape being curved downward in two stages, the second stage of which is defined by a tighter radius of curvature than in the first. In use, water running-off a roof of a building to which the Vahldieck system has been affixed follows, by capillary action, the double curved upper extent of said squared "C" shape and falls into the formed trough. Again, leaves and other debris are directed to locations other than into said trough. U.S. Pat. No. 4,858,396, Gutter by Rose et al. (Aug. 22, 1989) provides yet another variation on the same general theme "wherein a substantially flat extension which passes beneath the eves terminates in a free edge adjacent a narrow slot in an apex portion of an extended synthetic polymeric tube".

Patents directed to gutter brackets to aid in mounting and positioning of gutters are also found in the literature. U.S. Pat. No. 6,701,674, Snap-on Installation Gutter Protection System, With Mounting Bracket, And Method Of Use, by Albracht (Mar. 9, 2004), describes a snap-on bracket designed to hold a gutter cover in position in relation to the gutter. However, the Albracht patent fails to position the gutter so that the limited amount of debris that does enter the gutter will collect in the front of the gutter and be effectively carried away in manageable quantities by the resulting flow of collected water toward the downspout. Additionally, the Albracht patent fails to address the need for a fulcrum with which to aid insertion of the gutter cap under the drip edge along the roof line.

U.S. Pat. No. 5,495,692, Deflector Assembly For A Rain Gutter by Kuhns (Mar. 5, 1996), describes a gutter cap that slides under the shingles, extends over the gutter at a downward slope, and bends back towards the roofline. A bracket is affixed to the gutter cap and to the front lip of the gutter. However, the bracket fails to support the gutter by affixation to the roofline of the house, fails to position the gutter in a forward sloping manner, and fails to provide a fulcrum for insertion of the gutter cap under the drip edge.

Similar brackets to those of the present invention have been used by other gutter companies and are part of the public domain. These brackets are similar in design and construction but lack important features that individually or in combination can only be found on the present invention. GUTTER WIZARD has long used an L-shaped bracket capable of mounting into the roofline and also of mountably receiving the inner edge of a gutter cap. However this bracket fails to use a fulcrum for aiding insertion of the gutter cap under and behind the drip edge and does not push the front of the gutter down to aid in collection and removal of the limited debris that will enter the gutter irrespective of the presence of a gutter cap. This competitive gutter bracket mimics a long available metal bracket in that it provides a stop for receiving the inner edge of the gutter cap and provides apertures for the use of mounting screws and similar means.

The gutter bracket long in use by GUTTER SHUTTER also is similarly constructed in that it is formed into somewhat of an L shape. This bracket has the aforementioned fulcrum tab but fails to use a rear clip to aid in temporary mounting onto the gutter while a more permanent means of affixation is applied. This bracket also fails to lower the front of the gutter as is accomplished in the present invention.

Inventors have during the 1980's and on into the 1990's, also provided numerous systems particularly applicable for retro-fit to existing gutter systems. For instance, U.S. Pat. Nos. 4,404,775, 4,497,146 and 4,796,390 to Demartini describe systems " . . . which comprise a deflector having a sloped portion, the top edge region of which is adapted for juxtaposition to the roof shingles, and the bottom edge region of which is arcuate through a large radius cross-section. In such embodiments, the farthest outward extension is outside the outermost edge of the associated rain gutter and the lower edge is positioned between the edges of the rain gutter. Embodiments include means for attenuating the force of water and reducing the localized concentrating of water flowing thereover, such as longitudinal ridges and/or means for improving the surface wettability". The system can be visualized as essentially being "hook-shaped", (in side cross-section), in which, during use, the tip of the "hook" is oriented so as to face downward between the edges of an associated gutter system, and the shaft of said "hook" is positioned beneath shingles on the lower edge of the roof of a building to which the system is applied. The Demartini Patents also describe numerous mounting means for use in mounting the described system to existing gutter systems.

Another Patent, U.S. Pat. No. 4,455,791 to Elko et al. (Jun. 26, 1984), provides another system for similar use in retro-fit to existing gutter systems. "A protective structure for a gutter includes an elongated, impervious sheet wide enough to extend across at least about 90% of the width of the gutter and up under a lower edge of roofing material. The outer edge of the cover curls downwardly and the water follows the curvature by surface tension to cascade into the gutter. The cover may be held in place by straps that extend transversely across it and have one end engaged under the inwardly turned lip of the gutter and the other end engaged under roofing material". Alternatively clips can also be used for mounting the cover. Another Patent which describes a system for use in retro-fit to existing gutter systems is U.S. Pat. No. 5,016,404, Gutter And Bracket Assembly by Briggs (May 21, 1991). This system provides that "a sheet layer has an edge beneath the shingles and curves in front of and below the fascia above the gutter mouth forming a relatively small entrance region with the gutter. The apex of the curve extends beyond the gutter so that debris carried by water run off falls to the ground while the run off flows around the layer into the gutter".

U.S. Pat. No. 5,189,849, Roof rain gutter debris shield/run-off water control by Collins describes a two piece roof rain gutter debris shield/run-off water control system. In the words of Collins, " . . . a roof slope adaptor and its alternate means accommodate every and all roof slope/gutter juxtaposition, thereby eliminating traditional installation problems, a support stabilizer functions to provide stability and rigidity, while preserving the integrity of critical embodiment dimensions, a slope adaptor affixation clip means provides a plurality of attachment means". In essence, a gutter shield embodiment is attached to and above a gutter by means of a support stabilizer, and provides a horizontally oriented capillary cap portion at an upper aspect thereof. A roof slope adaptor provides continuity between the roof of a building to which the system is affixed and said horizontally oriented capillary cap portion. The upper edge of said roof slope adaptor is placed under shingles at the lower edge of said roof and the lower edge thereof rests atop said horizontally oriented capillary cap portion.

Additional Patents describe the use of slots or openings in gutter shield systems. For instance U.S. Pat. No. 4,866,890, Cover Member for Rain Gutters by Otto (Sep. 19, 1989) describes "a cover member for mounting on a conventional rain gutter on a building structure, consisting of a one piece thin, longitudinal shield to be inserted under the shingles of the roof and having a serrated outer edge which is bent downward a short distance back from its edge so that it can rest on the flat portion of the inner wall at the top lip of the gutter, the serrations providing small openings which water from the roof can run into the gutter and exclude pine straw or leaves from entering the gutter".

Another Patent, U.S. Pat. No. 4,876,827, Gutter Assembly by Williams (Oct. 31, 1989), describes that "the gutter assembly includes a curved water shed surface with a plurality of openings along its vertical portion which selectively allow the water to enter the gutter positioned below while excluding pine needles, leaves and other debris from engaging the gutter". U.S. Pat. No. 5,181,350 to Meckstroth describes that " . . . an elongated strip of extruded plastics material includes a generally flat longitudinally extending inner portion adapted to project under the shingles of a roof and a longitudinally extending outer portion adapted to seat on the outer edge portion of a rain gutter and project outwardly from the gutter to form a drip lip spaced from the gutter. A longitudinally extending intermediate portion of the strip integrally connects the inner portion to the outer portion and has a rounded nose surface above a U-shaped channel for directing water from the inner portion into the gutter and for deflecting leaves and other debris onto the outer portion of the strip for dropping them from the drip lip".

U.S. Pat. No. 4,571,896, Gutter Assembly by Condie (Feb. 25, 1986), describes that "a gutter assembly is provided which comprises an elongated, preferably transversely flexible sheet which when in an installed position extends along a building roof adjacent an edge of it, while extending below the roof edge. A pipe is provided which has a lengthwise extending slot which accommodates a side edge of the sheet through it adjacent an edge of the slot, while leaving room for entry of only water through the slot". "Such a gutter assembly inhibits entry of foreign matter into the pipe". A similar pipe arrangement is described in U.S. Pat. No. 4,551,956 to Axford. U.S. Pat. No. 5,216,851, Rain Gutter Covers And Roof Line Projectors by Kuhns (Jun. 8, 1993), describes a system with an extended flat portion which does not contain any apertures and serves to close the open top of a gutter to which it is applied. The extended flat portion is connected to an apertured portion, which apertured portion connects to the upper lip of the front wall of a gutter via a lip portion thereof. Said aperatures are shaped to direct water into the associated gutter while causing debris to simply flow over the outer front wall of the gutter. A Patent to Olsen, U.S. Pat. No. 4,631,875 describes a system with a generally planar surface which has a plurality of spaced parallel apertures which allow the entry of water into an underlying gutter. Patents to Way Sr. et al, U.S. Pat. No. 4,937,986 and to Pond, U.S. Pat. No. 2,847,949 describe gutter protection systems which provide an element which projects at a slope opposite to that of a roof to which the gutter they protect is attached, so that water exiting thereonto is slowed thereby. Both provide perforations in the oppositely sloped element so that water can enter to an underlying gutter.

The above survey of patents shows that numerous systems for preventing clogging of gutter systems have been invented and Patented. Users of many of said systems, however, have found that there remains need for improvement, particularly as regards ease of system installation and effective operation. The present invention provides a system which demonstrates improvement over the known identified existing art.

SUMMARY OF THE INVENTION

The present invention is a gutter bracket for use with new or existing conventional gutter systems employed to collect and manageably transport rainwater to drainage points along a roofline. The present invention provides utility not presently found in known systems.

As noted in the Background Section, numerous systems are available to collect rainwater off of a roof while deflecting debris, thus preventing clogging of the gutter system. These systems achieve differing degrees of success in inhibiting the formation of clogs in gutters but none are directed to achieving a self-cleaning gutter system.

Before presenting the present invention, it must be understood that no system presently known to the inventor can completely prevent the introduction of debris into the gutter while permitting adequate collection of rainwater from the roof. That being said, the ability of the present invention to manageably remove the debris introduced into the gutter system by the flow of water, or otherwise, is an important difference between the present invention and the prior art.

DETAILED DESCRIPTION OF THE INVENTION

Figure 1:
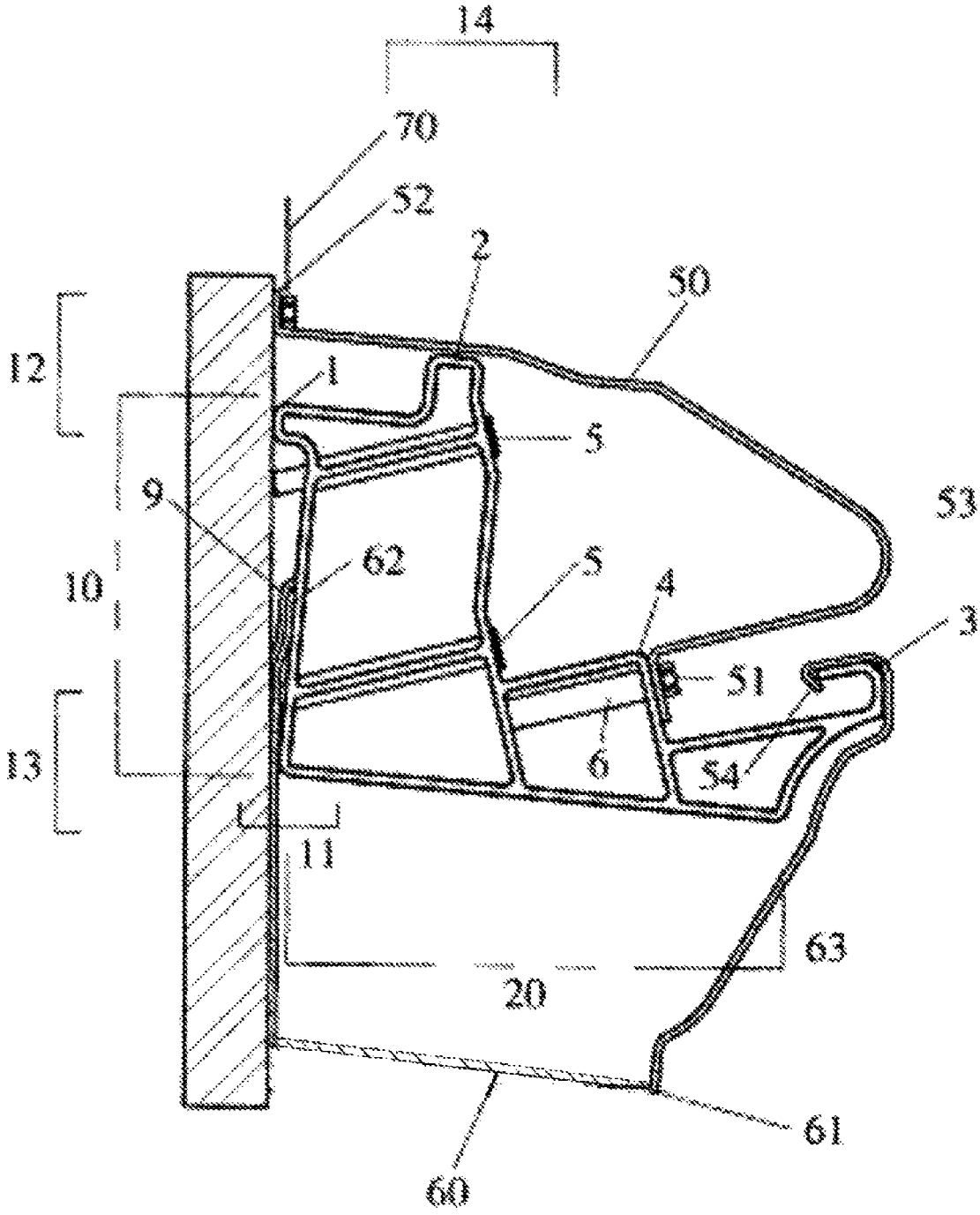
FIG. 1 depicts a cross-sectional view of the preferred embodiment of the invention as installed within a gutter system.

FIG. 1 depicts the preferred embodiment of the gutter bracket 100 used within the self-cleaning gutter 60 and beneath the gutter cap 50. The bracket 100 is L-shaped with a roughly vertical neck 10 extending upward more or less perpendicularly from a distal end 21 of a generally horizontal base 20 of said bracket 100. The top side 23 of the proximal end 22 of said horizontal base 20 has a gutter lip hook 3 curved up from said base and back toward said neck 10 of said bracket 100 in roughly the shape of a reverse letter "C". Apertures for mounting screws 5 extend through said neck 10 to guide the mounting screws through said neck 10 into the roof. The bracket 100 has a gutter cap stop 4 extending step-like from the base 20. The gutter cap 50 is mounted onto the bracket at the gutter cap stop 4 by means of a mounting screw 51 engaged with the gutter cap mounting aperture 6.

A positioning tab 1 extends distally from the top of said neck 10. This tab 1 serves to tilt the top of the neck 10 forward and thus the proximal end 23 of the base 20 slightly down from horizontal in an effort to push the proximal end 63 of the gutter 60 slightly down to create a low point in the gutter at the proximal end 63 bottom gutter edge 61.

A fulcrum tab 2 extends upward from the proximal end 14 of the top side 12 of the neck 10. This fulcrum tab 2 serves to facilitate insertion of a gutter cap 50 under and behind the drip edge 70 mounted along a roofline by allowing the installer to apply downward pressure to the proximal end 53 of the gutter cap 50 in order to raise the distal insertion edge 52 at the rear of the gutter cap 50 and achieve insertion behind the drip edge 70. The confined space within a gutter makes the insertion of the gutter cap 50 distal insertion edge 52 under and behind the drip edge 70 a difficult task.

A gutter clip 9 is located on the distal end 11 of the bracket neck 10. This gutter clip 9 provides temporary support for the bracket 100 during the installation process. The gutter clip 9 extends down the distal end 11 of the neck 10 and is inserted behind the distal wall 62 of the gutter 60 from above. The gutter clip 9 is tensioned so that it applies pressure to the distal end 11 of the bracket neck 10.

Figure 2:
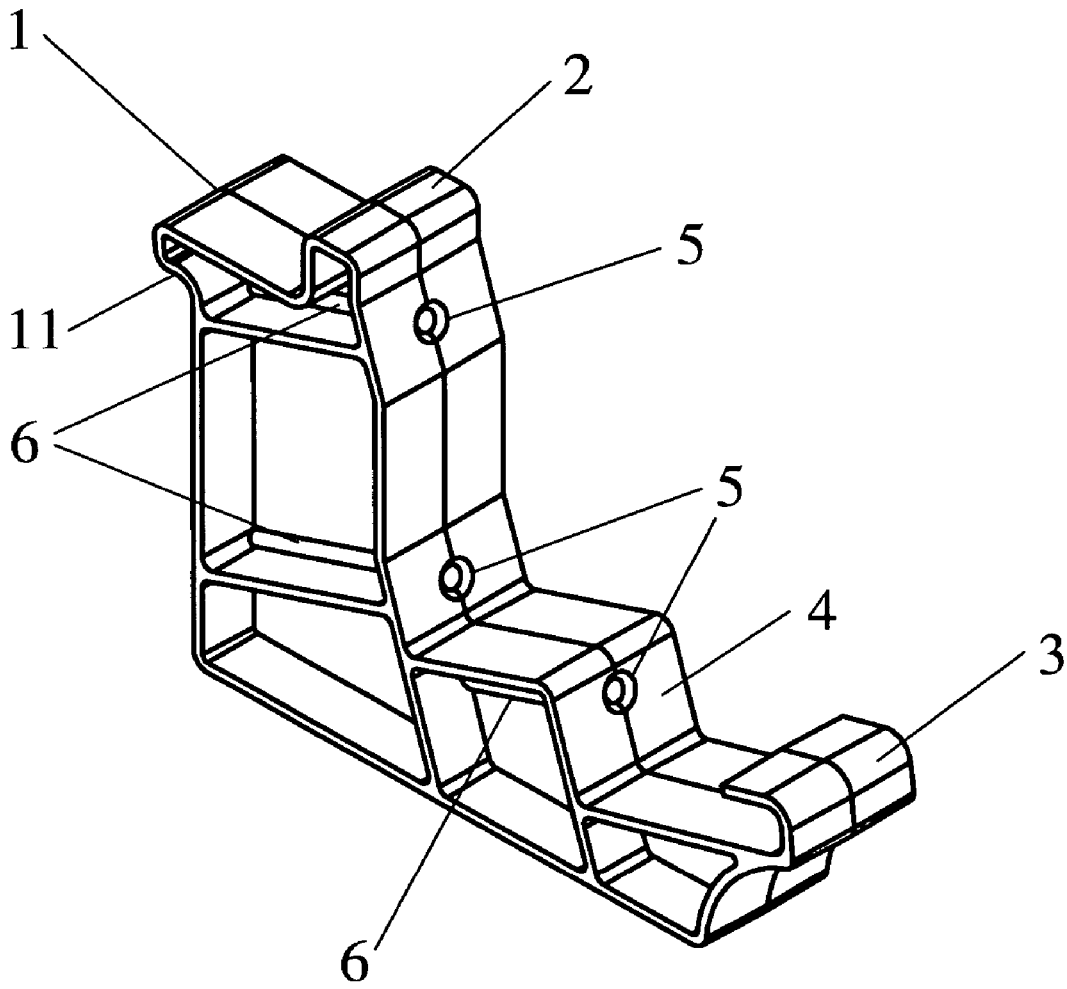
FIG. 2 depicts a perspective view of the preferred embodiment of the invention.

FIG. 2 depicts a perspective view of the bracket 100 such that the gutter cap mounting aperture 6 and the bracket mounting apertures 5 may be better visualized.

Figure 3:
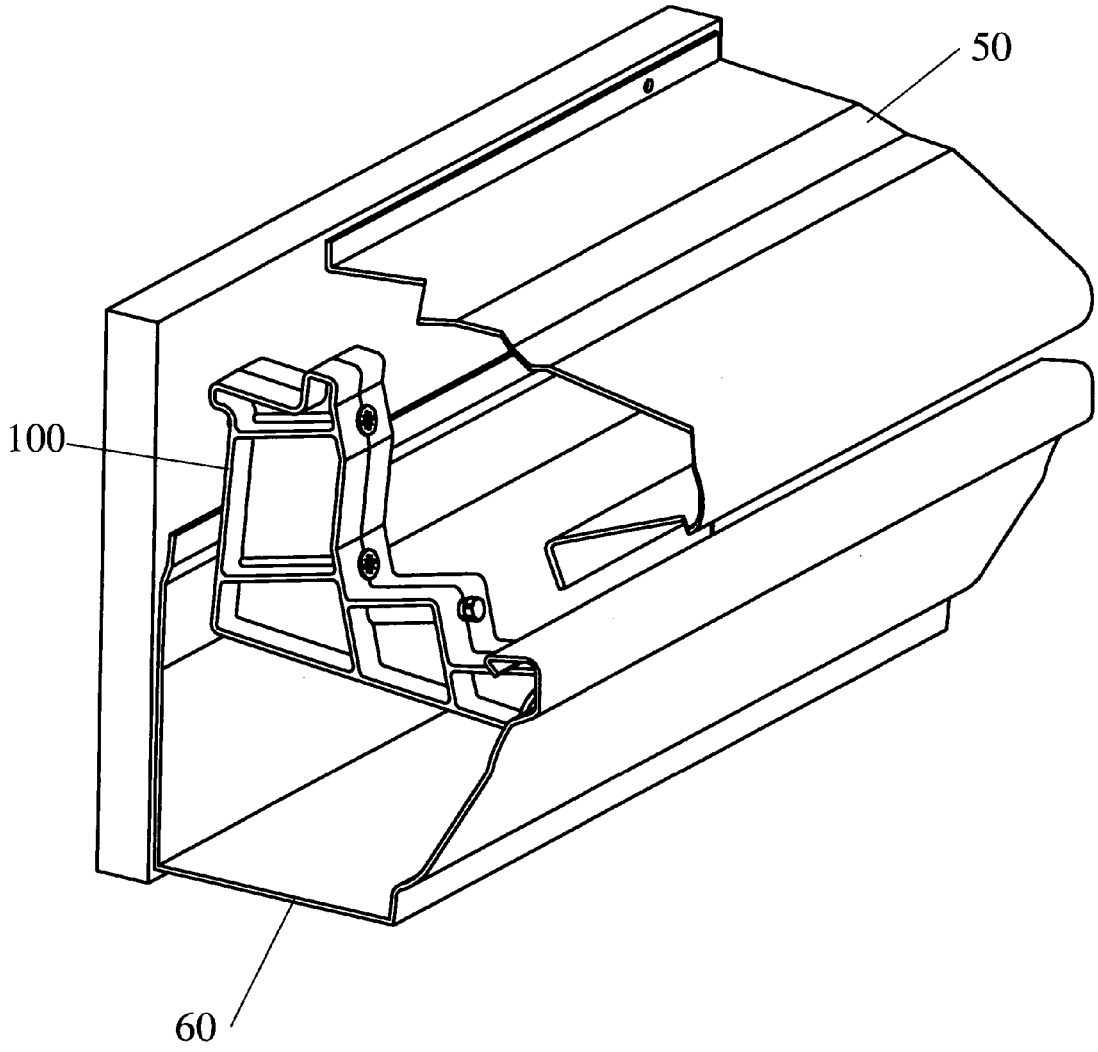
FIG. 3 depicts a perspective cross-sectional view of the gutter bracket in use within a gutter system.

The present invention assumes the existence of a gutter system at the lower edge of a sloped roof on an enclosed space, (e.g. a building, house, etc.). FIG. 3 shows such a gutter system in left-side perspective cross-section, with the gutter bracket 100 of the present invention present there within, and with a gutter cap 50 present at the top thereof.

The bracket is inserted into the rainwater channel created by the shape of the gutter 60. The neck of the bracket 10 backs up against the distal wall of the gutter 62. The leading edge 3 of the proximal end of the bracket base engages the lip 54 at the proximal wall 63 of the gutter. The top of the bracket neck 12 extends over the top of the distal wall of the gutter 62 and up to the gutter cap 50. A portion of the distal end 11 of the bracket neck 10 of protrudes over the top of the distal gutter wall 62 and serves to rotate the top of the gutter slightly forward with the center of rotation being the distal end of the bracket base 20 and the inferior end 13 of the bracket neck 10 at the roofline. This lowering of the proximal side 63 of the gutter 60 creates a low point along the bottom proximal edge 61 of the gutter 60, thus creating a collection point for water and debris and forcing the water to collect into the leading edge of the gutter channel serves to accelerate the velocity of the water being removed thus increasing the energy available for debris removal. The same effect is anticipated to result from an increase in the acute angle between the bracket neck and base.

The gutter cap of the present invention may be produced from many materials and be of differing configurations, provided that the functionality remains unaffected. The bracket is preferably constructed of rigid, lightweight plastic. The body is formed from a mold as with most mass produced plastic objects. The bracket is constructed such that the interior of the sides of the bracket are molded in a way to remove excess material to achieve cost and weight benefits. The remaining center wall that runs along the longitudinal axis of the bracket imparts additional support and rigidity to the structure. The apertures for inserting screws are roughly horizontally ribbed 31 along their length to provide support along the points of affixation. Vertical ribs 32 also extend along each face to the base of the gutter bracket for support and rigidity.

What is claimed is:

1. A gutter bracket comprising:

a substantially L-shaped bracket body; said bracket body having:

(a) a base possessing a first end which installs within a gutter against a roof side gutter wall inner surface and a second end which engages a gutter lip on an outside gutter wall;

(b) and (c) a substantially vertical neck rising from said first end of said base, said neck having a distal side facing said roof side gutter wall inner surface when installed within a gutter, a proximal side facing said gutter lip when installed within said gutter, a top end, an inferior end, and fastener channels extending through said neck; a gutter lip hook on said second end of said base; and a positioning tab extending distally from said top end of said neck so as to increase the spacing between said distal side of said top side of said neck and a support onto which said gutter is mounted thereby depressing said gutter lip when said gutter lip is engaged by said gutter lip hook and lower a proximal end of a gutter floor below a distal end of said gutter floor.

2. The system of claim 1, wherein said gutter lip hook is curved up from said proximal end of said base and back towards the neck to form a reverse "C" shape.

3. The system of claim 1, wherein said neck has a substantially vertically protruding fulcrum tab atop said top end of said neck beginning roughly at the proximal side of said neck and terminating prior to the distal side of said neck so as to allow said fulcrum tab to act as a fulcrum for an installed bracket during the installation of a gutter cap.

4. A rigid gutter bracket comprising:

a substantially L-shaped bracket body: said bracket body having (a) a base possessing a first end which installs within a gutter against a roof side gutter wall inner surface and a second end which engages a gutter lip on an outside gutter wall;

(b) a substantially vertical neck rising from said first end, said neck having a distal side facing said roof side gutter wall inner surface when installed within said gutter, a proximal side facing said gutter lip when installed within said gutter, a top end, an inferior end, a fulcrum tab protruding substantially vertically from the proximal end of said top end of said neck which serves to facilitate the insertion of a gutter cap lip behind a drip edge by permitting the insertion of said gutter cap lip behind said fulcrum tab whereby, said fulcrum tab acts as a fulcrum for the clutter cap, and possessing a gutter clip extending from said neck and down toward said bottom end of said neck to secure said gutter bracket to a distal gutter wall; said neck being of sufficient height to extend above the distal wall of a gutter;

(c) a roughly horizontal base protruding in a roughly perpendicular manner from said distal side of said bottom end of said neck; and (d) a positioning tab protruding roughly horizontally from said top end and said distal side of said neck in an opposing direction to said base, said tab protruding further horizontally and distally from said neck than said base and said fulcrum tab.

5. The gutter bracket of claim 4, said gutter clip extending from the distal end of said neck down the length of, and substantially parallel to said neck.

6. The method of creating a self-cleaning gutter system comprising:

(a) affixing a gutter cap over a gutter to inhibit the introduction of debris into said gutter;

(b) lowering the proximal end of the gutter using a gutter bracket, whereby water and debris will tend to collect in said proximal end; and (c) said act of affixing a gutter cap including the step of rotating said gutter cap about a fulcrum tab atop said bracket whereby a distal end of said gutter cap can be inserted under and behind a roof drip edge.

7. A gutter protection system comprising:

(a) a gutter cap; and (b) a rigid gutter bracket, said bracket being substantially L-shaped when installed within a gutter, said bracket having a roughly horizontal base possessing a first end which installs within a gutter against a roof side gutter wall inner surface and a second end which engages a gutter lip on an outside gutter wall;

(c) a substantially vertical neck rising from said first end, wherein said neck has a distal side facing said roof when installed within a gutter, a proximal side facing said gutter lip when installed within said gutter, a top end, and an inferior end; fastener channels through said neck from said proximal side to said distal side, a positioning tab extending from the distal side of said neck, a fulcrum tab extending vertically from said proximal said of said top end of said neck and terminating partway between said distal side of said top end of said neck and said proximal side of said top end of said neck, and said base having a gutter lip hook curved up from said second, end of said base and back towards said neck to form a reverse "C" shape.

* * * * *